United States Patent [19]

Prewett et al.

[11] 4,431,137

[45] Feb. 14, 1984

[54] SOURCES FOR SPRAYING LIQUID METALS

[75] Inventors: Philip D. Prewett, Abingdon; Leonard Gowland, Grove; Keith L. Aitken, Kennington, all of England

[73] Assignee: United Kingdom Atomic Energy Authority, London, England

[21] Appl. No.: 438,912

[22] Filed: Nov. 3, 1982

Related U.S. Application Data

[63] Continuation of Ser. No. 177,451, Aug. 12, 1980, abandoned.

[30] Foreign Application Priority Data

Aug. 23, 1979 [GB] United Kingdom ..... 7929361

[51] Int. Cl.[3] ..... B05B 5/00

[52] U.S. Cl. ..... 239/690; 239/590; 118/302; 75/0.5 C

[58] Field of Search ..... 239/3, 82, 504, 542, 239/590, 598, 601, 690, 697, 698, 708, DIG. 19, 620, 627; 118/302; 427/422; 313/333, 362, 232, 163; 75/0.05 C, 0.05 A

[56] References Cited

U.S. PATENT DOCUMENTS 2,840,185 6/1958 Norgren ..... 222/564 UX 3,475,636 10/1969 Eckardt ..... 313/163 X 4,088,919 5/1978 Clampitt ..... 313/362

4,264,641 4/1981 Mahoney ..... 427/422 X

OTHER PUBLICATIONS

Swatik and Hendriks, *Production of Ions by Electrohydrodynamic Spraying Techniques,* AIAA Journal, vol. 6, pp. 1596–1597, Aug. 1968.

*Primary Examiner*—John J. Love

*Assistant Examiner*—Paul A. Sobel

*Attorney, Agent, or Firm*—William R. Hinds

[57] ABSTRACT

A source for producing a spray of drops and ions of a liquid material under the action of an electric field, comprises an emitting point in the shape of a cone with a rounded tip, the vertex angle of which is between thirty and forty degrees and which projects beyond a base structure by a distance of between some one and three millimeters, means for supplying a liquid material to be sprayed to the emitting point and a field generating electrode whereby there may be applied to the emitting point an electric field sufficient to disrupt the liquid material at the emitting point and provide a spray of liquid drops and ions, the emitting point being made of a material which is wetted by the liquid material and has a low solubility in the liquid material.

16 Claims, 4 Drawing Figures

SOURCES FOR SPRAYING LIQUID METALS

This is a continuation of application Ser. No. 177,451 filed Aug. 12, 1980, now abandoned.

The present invention relates to sources for the spraying of liquid metals.

The deposition of metallic coatings by means of sprays of ions or small droplets formed by field emission from pointed needles is a known technique. Types of sources of metal droplets and ions are described in our UK Pat. No. 1,442,998 and Applications Nos. 15111/76 and 30722/77. Whether ions or droplets are produced by a given source is dependent mainly upon the dimensions and shape of the source and upon the strength of the applied electric field.

According to the present invention there is provided a source for producing a spray of drops and ions of a liquid material under the action of an electric field, comprising an emitting point in the shape of a cone with a rounded tip, the vertex angle of which is between thirty and forty degrees and which projects beyond a base structure by a distance of one to three millimetres, means for supplying a liquid material to be sprayed to the emitting point, and a field generating electrode whereby there may be applied to the emitting point an electric field sufficient to disrupt the liquid material at the emitting point and provide a spray of liquid drops and ions, the emitting point being made of a material which is wetted by the liquid material and has a low solubility in the liquid material.

Figure 1:
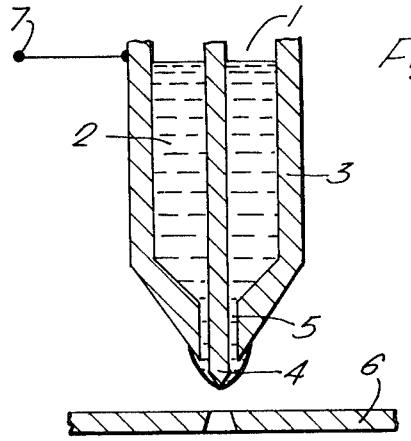
Figure 3:
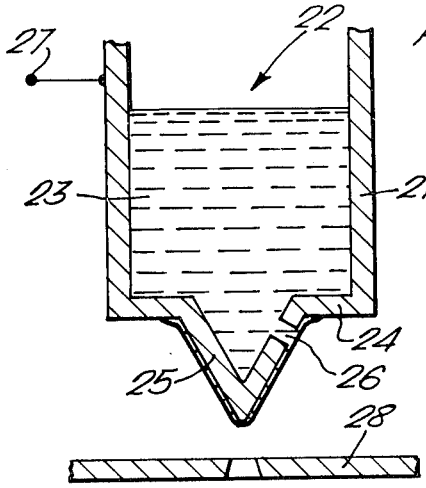
Figure 2B:
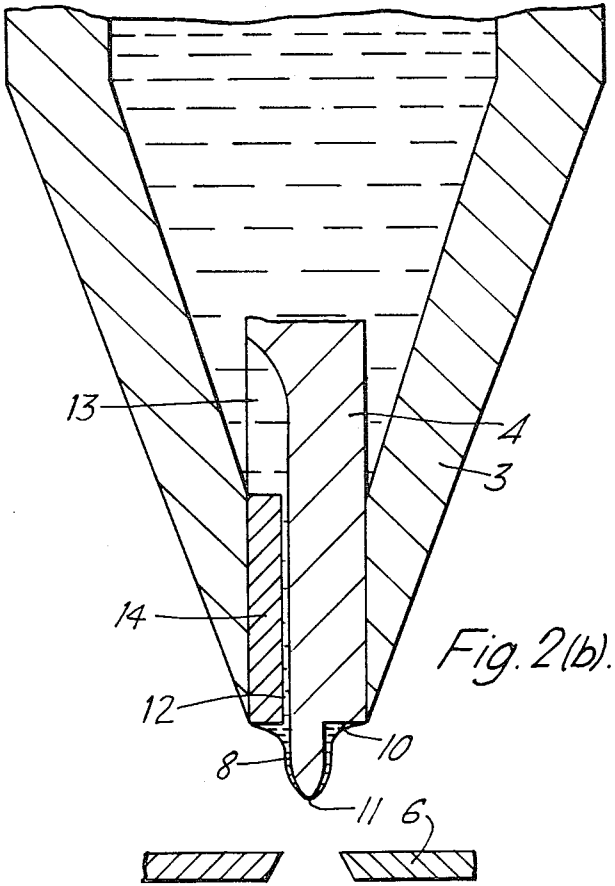
Figure 2A:
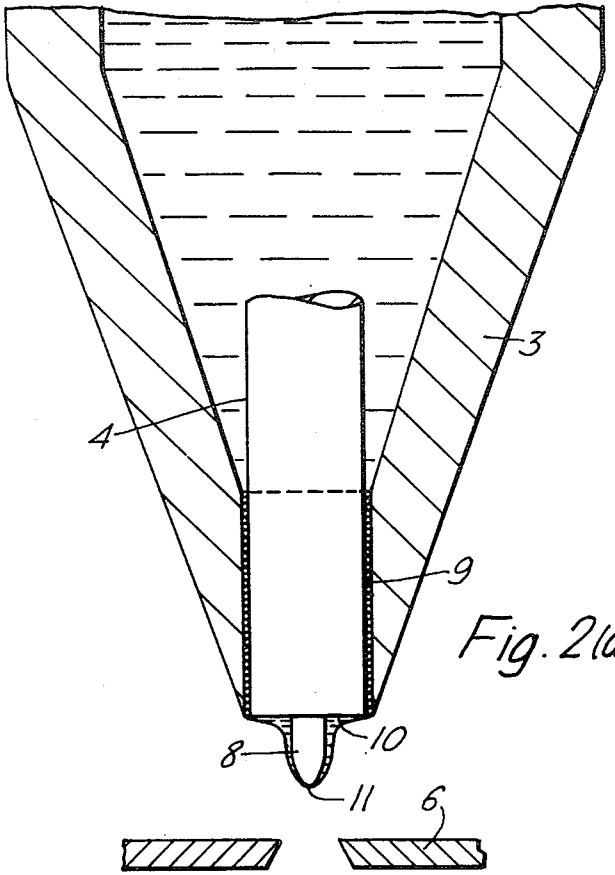

The invention will be described, by way of example, with reference to the accompanying drawings, in which:

FIG. 1 shows a diagrammatic longitudinal section of a source embodying the invention; and FIGS. 2(*a*) and 2(*b*) show diagrammatic longitudinal sections of preferred embodiments for the spraying of gold and gold alloys; and FIG. 3 shows a diagrammatic longitudinal section of another embodiment of the invention.

Referring to FIG. 1, a source for producing a spray of liquid metal drops consists of a reservoir 1 for the liquid metal 2, which terminates in a hollow cylindrical base structure 3 some 7 mm in outside diameter. The internal diameter of the base structure 3 is some 5 mm reducing to some 0.5 mm. Centrally placed in the base structure 3 is an emitting point 4 which projects some one to three mm from the end of the base structure 3. The diameter of the emitting point 4 is 25 $\mu$m less than the hole 5 in the centre of the base structure 3. Both the spraying tip of the emitting point 4 and the end of the base structure 3 are conical in shape with a vertex angle of 35°, although angles of 30 and 40 degrees are satisfactory. The emitting point 4 has a tip radius of between 20$\mu$ and 100$\mu$ depending upon the proportion of droplets required in the spray. For a given voltage, a tip of smaller radius will produce a higher ratio of ions to droplets than a blunter emitting tip. The most suitable value of tip radius for most coating applications is some 60 $\mu$m.

An electric field sufficient to disrupt the film of liquid metal which forms over the emitting point 4 can be applied to the source by means of an extraction electrode 6 which is usually a circular aperture some 2 to 5 mm in diameter, and a terminal shown schematically at 7. If the source needs to be heated to maintain the metal to be sprayed in the liquid state, this can be done either by means of an electrically heated filament (not shown) surrounding the reservoir and base structure or by any other convenient method. The rate of feed of liquid to the emitting point 4 is controlled by surface forces, by the applied electric field and by viscous drag effects, together with gravity.

Alternatively, in this form of the embodiment, the base structure 3 may be made of a material, the outside of which is not wetted by the liquid metal. This may be necessary in some instances to prevent flooding of the emitting point 4 by an excess of liquid metal.

This is the case for the spraying of gold and gold alloys, a preferred embodiment for which is shown in FIG. 2(*a*). The base structure 3 is made from carbon which is not wetted by gold, the emitting point 4 is made of a tungsten wire of 1.6 millimeters diameter, reducing to 0.5 millimeters diameter over a portion 8 some one to three millimeters long which protrudes beyond the end of the base structure 3. The hole 5 in the base structure 3 has a diameter of some 1.8 to 2.0 millimeters. The gap between the wire 4 and the base structure 3 is filled by a tightly wound spiral 9 of tungsten wire of 0.1 millimeters diameter. The spiral 9 provides a capillary route along which the liquid metal flows to form a meniscus at the shoulder 10 formed by the junction between the main part of the emitting point 4 and the reduced portion 8 of the emitting point 4, and thence over the surface of the reduced portion 8 of the emitting point 4 to the spraying tip 11 from which it is removed in the form of droplets and ions by the action of the applied electric field.

The presence of the spiral 9 and the shoulder 10 produced by the reduction in diameter of the wire is fundamental to the formation of the liquid meniscus in this region in the absence of a wetted base structure 3. An adequate flow of liquid from the shoulder at 10 over the reduced portion 8 of the emitting point 4 is ensured by the provision of meridianal grooves, not shown, on the surface of the conical end of the emitting point 4, which forms the spraying tip 11.

Microscopic observation of the sprayer during operation has confirmed our model of the sprayer behaviour which is, referring again to FIG. 2(*a*) as follows:

Liquid metal is fed by a combination of gravity and surface wetting forces from the reservoir through the spiral controlling region 9 to form the meniscus on the shoulder region 10. As the voltage is increased, the loss of material from the spraying tip 11 increases. This loss must be supplied by flow from the shoulder 10 along the reduced length 8 of the emitting point 4. An adequate supply of liquid will be maintained only if there are sufficient continuous liquid paths between the shoulder 10 and the spraying tip 11. This is the reason for the fine meridinal grooves. At operating currents of some 60 $\mu$A or more when the emission of metal from the spraying tip 11 is relatively large, the meniscus surface at the shoulder 10 is seen to withdraw along the shank of the reduced portion 8 of the emitting point 4 and assumes a profile which, at equilibrium, closely follows the underlying topography of the emitting point 4. At currents of some 20 $\mu$A when the emission from the spraying tip 11 is much smaller, being chiefly composed of ions with relatively few droplets, the meniscus surface resumes a profile which is proud of the needle topography in the region of the shoulder 10. If the source is operated for prolonged periods in this low current regime, the point on the meniscus at which it blends into the underlying needle structure moves closer and closer to the spraying tip 11. Under extreme conditions, a Taylor cone can be formed and the needle structure is lost from view, being completely submerged by the liquid meniscus of the sprayer which is then said to be 'flooded'. The source behaviour may be summarized as follows, referring to FIG. 2(*a*).

1. Flow to the meniscus is controlled by the spiral 9 and during normal operation depends only weakly upon the applied field.
2. The meniscus at the shoulder 10 acts as an intermediate reservoir the size and shape of which varies with the emission rate from the spraying tip 11.
3. All material emitted by the source (other than evaporation of atoms which occurs from all exposed liquid surfaces) occurs from the spraying tip 11, the rate of emission being determined by the magnitude of the field applied in this region.
4. Material emitted in this way is provided by flow along meridianal grooves from the meniscus at the shoulder 10, which changes in size and shape accordingly.
5. The electrical forces which determine the flow from the shoulder 10 to the spraying tip 11 act at the spraying tip 11, being coupled to the shoulder 10 by continuity in the incompressible liquid film which joins the shoulder 10 to the spraying tip 11. Electrical forces in the region of the shoulder 10 usually are relatively insignificant.

An alternative to the spiral flow control arrangement may be used in another embodiment of the sprayer which is shown schematically in FIG. 2(*b*). In this embodiment, the flow channel between reservoir and meniscus is a narrow capillary 12 of 0.05 mm square section extending for some 3 mm from the reservoir, to emerge at the corner where the shoulder 10 of the emitting point 4 meets the reduced portion 8. (This channel is created by first machining a rectangular groove 13 of 0.55 mm depth and 0.05 mm width along one side of the emitting point 4 from the shoulder 10 to a distance some 4.5 mm above. The groove 13 is then partially blocked using a fillet 14 of tungsten of 0.5 mm×3 mm×0.05 mm leaving a 0.05 mm×0.05 mm×3 mm interior channel 12 in the emitting point 4 which extends some 3 mm into the narrowest portion of the base structure 3.

FIG. 3 shows an alternative form of a liquid metal spray source consisting of a cylindrical base portion 21 some 5 to 7 mm in diameter which forms a reservoir 22 for a liquid metal 23 droplets of which are to be generated by the source. The bottom 24 of the base portion 21 has a conical emitting point 25 which projects some 2 mm below the bottom 24 of the base portion 21. As in the source previously described, the vertex angle of the emitting point 25 is 35 degrees. The radius of the tip of the emitting point 25 is somewhat greater than 25 μm. At the region where the emitting point 25 joins the remainder of the base portion 21 there is provided a hole 26 some 50 μm in the diameter. The hole 26 can be up to 0.5 mm in diameter. The hole 26 allows liquid metal to pass from the reservoir 22 to the emitting point 25 over the surface of which it flows by means of surface wetting at a rate which causes liquid metal drops to be discharged from the tip of the emitting point 25 under the influence of an electric field applied by means of a terminal 27 and an electrode 28. As before, arrangements can be made to heat the reservoir 22 to keep the metal in a liquid state, if it should prove necessary. If desired, more definite control over the rate of feed of the liquid metal 23 to the emitting point 25 can be achieved by means of a piston operating on the surface of the liquid metal 23 in the reservoir 22.

The materials used for both forms of liquid metal spray source have to be compatible with the liquid metal to be sprayed. The general criteria are that the source materials should be wetted by, but not soluble in, the metal to be sprayed. However, for some purposes some limited solubility of the source material in the liquid metal is permissible. For example, if the metal to be sprayed is gold, then the base structure 3 and the emitting point 4 of the first embodiment can be made of molybdenum and molybdenum or tungsten, respectively, though a carbon reservoir with tungsten emitter and feed arrangement as shown in FIG. 2(*a*) or 2(*b*) is preferred for reliable behaviour over prolonged periods. The above materials can be used for the reservoir 22 and emitting point 25 of the second embodiment.

For spraying aluminum or its alloys, a boron nitride/titanium diboride composite can be used for the emitting points of both embodiments. For spraying gallium, either tungsten or tantalum can be used. For spraying silicon, a graphite emitting point is used.

We claim:

1. A source for producing a spray of drops of a liquid material under the action of an electric field, comprising a solid needle having an emitting point made of a material which is wetted by the liquid material and which has at most a low solubility in the liquid material, the emitting point having a vertex angle of between thirty and forty degrees, an annular structure surrounding the needle and from which the emitting point projects by a distance of between one and three millimeters, an extraction electrode, and supply and control means for supplying the liquid material to the emitting point at a controlled rate such that when an electric field is applied to the emitting point of a magnitude such as to disrupt the liquid material at the emitting point a spray of drops of the liquid material is produced, said supply and control means including a flow control device in the region where the needle emerges from the annular structure.

2. A source according to claim 1, wherein the flow control device comprises a spiral flow restrictor.

3. A source according to claim 2, wherein the spiral flow restrictor comprises a wire helix attached to the emitting point prior to its insertion in the annular structure.

4. A source according to claim 1, wherein the needle is a close fit in the orifice of the annular structure and the flow control device comprises a longitudinal slot cut in the needle.

5. A source according to claim 4, wherein the longitudinal slot is provided with a restrictor in the region where it emerges from the annular structure.

6. A source according to claim 1, wherein the annular structure is made of a material which is not wetted by the liquid material.

7. A source according to claim 1 wherein the emitting point has a tip radius of between 20μ and 100μ.

8. A source according to claim 7, wherein the tip radius of the emitting point is 60μ.

9. A source according to claim 1, wherein the vertex angle of the tip of the emitting point is 35°.

10. A source according to claim 1 for spraying gold wherein the annular structure and needle are made of molybdenum.

11. A source according to claim 1 for spraying gold wherein the needle is made of tungsten.

12. A source according to claim 1 for spraying aluminium or its alloys wherein the needle is made of a composite of boron nitride and titanium diboride.

13. A source according to claim 1 for spraying gallium wherein the needle is made from tungsten or tantalium.

14. A source according to claim 1 for spraying silicon wherein the needle is made of graphite.

15. A source for producing a spray of drops of a liquid material under the action of an electric field, comprising a solid needle having an emitting point made of a material which is wetted by the liquid material and which has at most a low solubility in the liquid material, the emittint point having a vertex angle of between thirty and forty degrees, an annular structure surrounding the needle and from which the emitting point projects by a distance of between one and three millimeters, an extraction electrode, and supply and control means for supplying the liquid material to the emitting point at a controlled rate such that when an electric field is applied to the emitting point of a magnitude such as to disrupt the liquid material at the emitting point a spray of drops of the liquid material is produced, wherein the needle has a shoulder formed in it so that the portion which projects beyond the base structure has a cross-section to form the emitting point which is smaller than that of the portion of the needle which is within the base structure.

16. A source according to claim 15, for the spraying of gold wherein the annular structure surrounding the needle at its point of projection is made of carbon and the emitting point is made of tungsten.

* * * * *